United States Patent [19]

White

[11] 4,063,533

[45] Dec. 20, 1977

[54] MULTIPLE BRUSH DEVELOPER APPLYING APPARATUS WITH A TONER DIVERTER BLADE

[75] Inventor: Edward Montcalm White, Boulder, Colo.

[73] Assignee: International Business Machines Corporation, Armonk, N.Y.

[21] Appl. No.: 710,758

[22] Filed: Aug. 2, 1976

[51] Int. Cl.[2] ..... G03G 15/09

[52] U.S. Cl. ..... 118/658; 427/18

[58] Field of Search ..... 118/658, 656, 657, 653; 427/18; 355/3 DD

[56] References Cited

U.S. PATENT DOCUMENTS

| | | | |
|---|---|---|---|
| 3,572,289 | 3/1971 | Maksymiak | 118/658 |
| 3,608,522 | 9/1971 | Davidson | 118/658 |
| 3,638,614 | 1/1972 | Young et al. | 118/658 |
| 3,641,980 | 2/1972 | Bickmore | 355/3 DD |
| 3,643,629 | 2/1972 | Kangas et al. | 118/658 |
| 3,703,395 | 11/1972 | Drexler et al. | 427/18 |
| 3,911,864 | 10/1975 | Hudson | 118/658 X |
| 3,937,181 | 2/1976 | Handa | 118/658 |
| 4,003,335 | 1/1977 | Kurita et al. | 118/658 |
| 4,008,686 | 2/1977 | Katakura | 427/18 |
| 4,015,561 | 4/1977 | Howard et al. | 118/657 X |

OTHER PUBLICATIONS

Hull, Application Serial No. 729,623, Laid Open to Public Inspection on 6/7/77, as noted at 849 O.G. 1221, Apr. 9, 1968.

IBM Technical Bull., Daniels et al., "Magnetic Brush Developer," vol. 18, No. 8, (Jan. 1976), pp. 2413-2414.

*Primary Examiner*—Mervin Stein
*Assistant Examiner*—Andrew M. Falik
*Attorney, Agent, or Firm*—Earl C. Hancock

[57] ABSTRACT

Magnetically attractable toner carrying materials are transported into contact with latent electrostatic images on the photoconductor surface of a drum by multiple magnetic roll brush elements. One brush extracts toner material from a source and transports it through a zone including contact of the toner carrying materials with one area of the latent image drum surface. The first brush acts as a conveyor and a diverter blade or bar is arranged to redirect at least a portion of the magnetic toner carrying materials onto the second brush. The second brush transports the diverted materials into contact with the latent image drum surface at yet another area thereof. The diverter bar or blade is positionable so as to control the quantity of materials diverted or transferred between the brush rolls.

10 Claims, 5 Drawing Figures

MULTIPLE BRUSH DEVELOPER APPLYING APPARATUS WITH A TONER DIVERTER BLADE

BACKGROUND OF THE INVENTION

1. Field of the Invention

This invention relates to apparatus and methods for transferring developer materials from a source to multiple areas of a latent image containing surface. More particularly, the present invention is concerned with magnetic brush roll apparatus and methods for transferring magnetically attractable toner carrying materials from a source into contact with multiple areas of a latent image carrying surface. The invention is especially useful in conjunction with plain paper copying machines requiring development of latent electrostatic images by use of magnetizable carriers and triboelectrically compatable toner powders or the like.

2. Description of the Prior Art

Conventional electrophotography copiers typically employ a sequence of steps including the charging of a photoconductor surface such as a plate, drum, or belt, the exposure of this surface to light reflected from a document to be copied, the application of developer materials to the photoconductor surface, the transfer of these developer materials to the paper and subsequent fusing of the developer materials along with other housekeeping steps associated with the photoconductor. Some prior art copier devices introduce the developer materials to the photoconductor surface by pouring or similar steps. Other prior art copiers use toner carrying mixes comprised of magnetizable or magnetically attractable carrier elements such as plastic encased steel beads and triboelectrically compatable toner powder carried by these beads. This type of toner carrying mix has made it possible to apply the toner to the photoconductor in a brush like manner by means of magnetic brush rollers. Typically, these rollers include a magnet configuration for adhering the toner carrying mix to the surface of a rotating roller cylinder and with the magnetic field being coextensive through a zone between the source of the toner material and the area in proximity to the photoconductor surface wherein developer application occurs.

Increased process speeds for faster operating copiers has necessitated higher mix flow rates and wider area coverage of exposed photoconductor surface to supply sufficient toner particularly required to develop gray and half-tone images with the copy quality available through lower process speeds. Unfortunately, the efficiency of single roll magnetic brush developers is relatively low, such as on the order of one percent in terms of the amount of toner used to the amount delivered in the mix. Accordingly, various prior art devices have been developed for the purposes of applying developer containing materials to several areas or a larger area of the photoconductor surface so as to increase the efficiency of toner transfer and allow increasing speeds of copier operation. Generally, such multiple magnetic brush configurations employ magnetic field generating magnets within the rollers which effect direct transfer of unused toner containing materials from one roller onto the next roller. In some instances, this transfer has been augmented by use of scraper plates and the like. In many such multiple magnetic brush systems, either the brush rollers which apply the toner carrying material to the latent image drum surface are arranged so as to directly engage a sump or other source of the materials or else the rollers are arranged in a series with alternate such rollers being positioned to act merely as conveyors rather than to provide any useful function in applying toner carrying material to the image drum surface. The alternate conveyor brush roller devices suffer the disadvantage of requiring greater physical space and thus are primarily limited in utility to photoconductor strips as contrasted to photoconductor drums.

Although some prior art multiple brush roller apparatus has been developed wherein all rollers apply toner carrying materials to the photoconductor surface, such prior art apparatus requires special interconnecting magnet field configurations between the rollers such that the toner exiting from the initial roller is completely attracted by the subsequent roller. Thus, there has been no ability to control the amount of toner transferred from the initial brush roller to subsequent rollers.

SUMMARY OF THE INVENTION

The present invention relates to apparatus and methods for development of latent electrostatic images and particularly to mechanisms and methods for developing such images utilizing a magnetizable carrier and triboelectrically compatable toner powder or the like. More specifically, this invention relates to the development of latent images on a surface over an extended developing zone with greater efficiency than is possible with prior art single roll magnetic brush developers.

The present invention is concerned with apparatus and methods for applying magnetically attractable toner carrying materials from a supply source to an area of a member containing a latent image which image requires development. An initial magnetic brush including a movable element (such as a cylindrical roll) associated with a first magnetic configuration magnetically extracts and retains the toner carrying materials from the supply source on a surface of this movable element. The initial magnetic brush is arranged for transporting the extracted materials into intimate contact with a first portion of the latent image area. A second magnetic brush arrangement is mounted adjacent to the first brush and has a movable element cooperative with a second magnet configuration for magnetically retaining the toner carrying materials on the surface of the movable element so as to deliver the retained materials into intimate contact with a second portion of the latent image area. Between the first and second brushes is positioned a means for diverting at least a portion of the toner carrying materials from the surface of the movable element of the first brush onto the surface of the movable element of the second brush for transport by the second brush to the second latent image area portion. As will be more readily apparent from the subsequent description of the preferred embodiments, various arrangements for accommodating different rotational movement of the brushes can be included and the toner carrying material diverting apparatus arranged to be adjustable so as to directly control the quantity of toner carrying materials transferred between rolls.

The foregoing and other features and advantages of the present invention will be more readily apparent from the following more particular description of exemplary preferred embodiments of this invention as illustrated in the accompanying drawings.

DETAILED DESCRIPTION OF THE PREFERRED EMBODIMENTS

Although the implementations of the present invention in the exemplary preferred embodiments shown and described are illustrated in conjunction with dual magnetic brush rolls, it will be readily understood that the invention is equally applicable to any multiplicity of such rolls. Further, the exemplary preferred embodiments have been shown and will be described in conjunction with brush rolls having different diameters, but it will be recognized that other diametric interrelationships can be employed including brush rolls of equal diameters.

Figure 1:
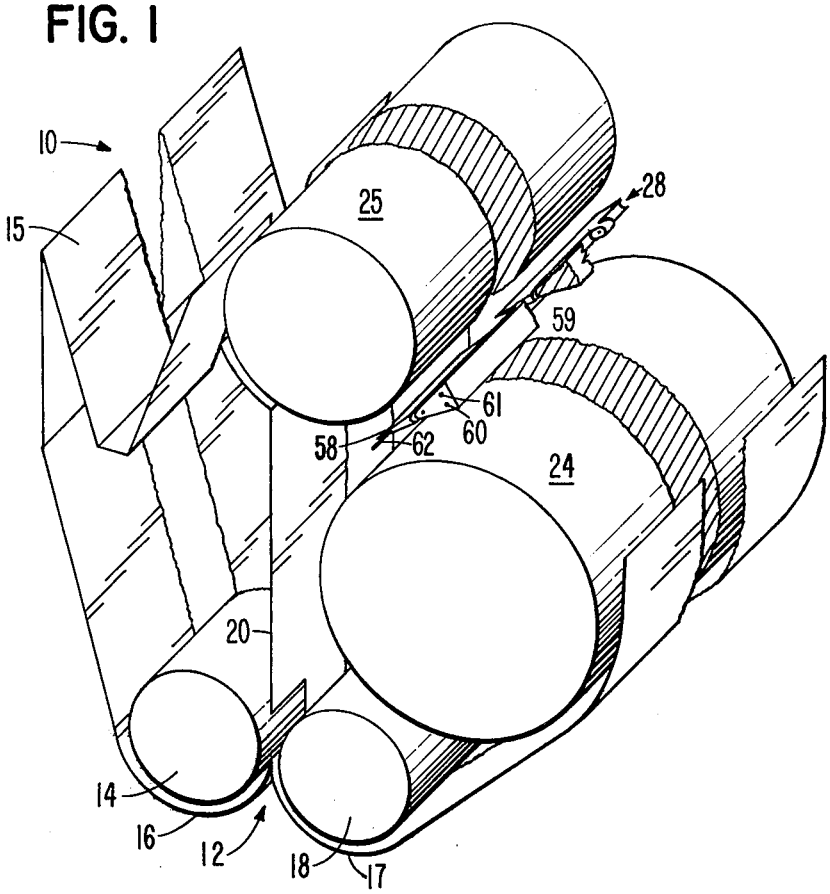
FIG. 1 is a broken perspective view of certain elements contained within a copier machine illustrating one form of implementation of the present invention.
Figure 2:
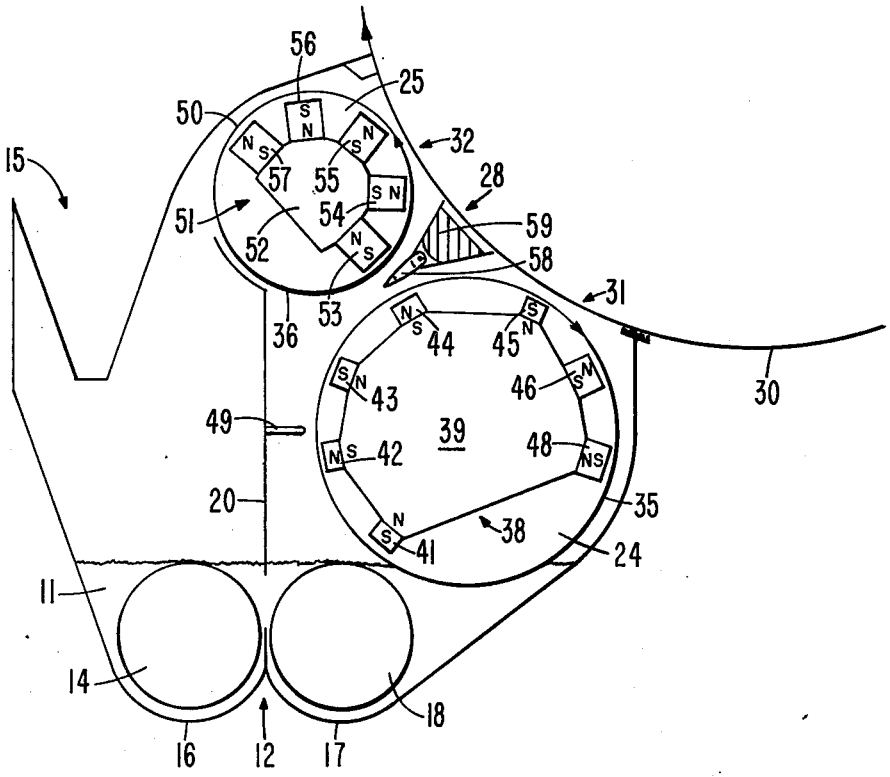
FIG. 2 is a side partially sectioned view of the apparatus of FIG. 1.

Shown in FIGS. 1 and 2 is an assembly 10 for applying toner to develop latent images on a photoconductive surface (not shown). Toner contained within a sump 12, replenished from source 15, is mixed by auger 14 within channel 16. The mix and toner carrying materials are contained within assembly 10 by side walls enclosing the ends thereof which side walls have been omitted from FIG. 1 and the operation of replenisher tray 15 in adding toner is conventional. Passageways at each end of barrier wall 20 can be set to control the level of mix introduced to auger channel 17 for cooperation with auger 18.

Auger 18 draws mix back to the near end of channel 17 where it is reintroduced to channel 16 and auger 14 via an appropriate opening in barrier wall 20 visible in FIG. 1 and 2. Augers 14 and 18 may have different leads, outside diameters, and flighting heights along their lengths to assure uniform mix circulation in the auger cavities 16 and 17. As is understood in the art, the auger "lead" is the distance between flights measured along a parallel to the axis from one point on a flight to the corresponding point on the next section of flighting. Also "flighting height" means the distance from the core or body of the auger in a direction normal to the axis to the outer diameter of the circle described by the flight or thread. Further, augers 14 and 18 can be at common or different elevations and the mix level controlled relative to conveyor brush roll 24 such as by adjusting a gate between the two auger cavities 16 and 17. As is readily apparent from FIGS. 1 and 2, auger cavity 16 receives mix discharged from brush roll 25 whereas cavity 17 receives the mix discharged from roll 24.

As best seen in FIG. 2, conveyor brush roll 24 transports mix 11 to a point approximately aligned with the line of centers between rolls 24 and 25 where diverter assembly 28 directs a selected proportional amount of mix for transfer from the surface of roll 24 to the surface of roll 25. As indicated by the arrows on the cylindrical drum surfaces for rolls 24 and 25, these magnetic brush devices rotate in opposite directions. That is, roll 24 rotates clockwise as seen in FIG. 2, so as to convey mix 11 from sump 12 and particularly cavity 17 thereof above auger 18 to approximately the line of centers between rolls 24 and 25 where the non-magnetic flow diverter-splitter 28 proportions the division of the mix between the rolls. Accordingly, it is readily apparent that both rolls 24 and 25 serve as developing rolls in that their magnetic field configuration permits transport of developer mix to separate contact areas on the photoconductor surface of drum 30, particularly at the areas indicated generally by 31 and 32. Assuming that drum 30 is rotating in the direction shown, the oppositely directed rotation of roll 24 produces counter flow developing which has been found to be more efficient than direct or commonly directed flow but hazards some relatively high toner clouding. However, with roll 25 located subsequent to roll 24 in the copy cycle and rotating counterclockwise to give direct flow with the photoconductor surface of drum 30, toner clouding is restricted to the region between rolls 24 and 25 and is beneficial in enhancing development. Bias voltages on rolls 24 and 25 can be independently adjusted to control background levels. The flow diverter-splitter assembly 28 may also serve as a biasing electrode.

Each magnetic brush roll 24 and 25 operates independently of the other, although mix released prior to return to the sump area by roll 25 may cascade back into control by the magnetic field of roll 24 and no magnetic field interactions are necessary. Counter rotation of roll 24 at a lower rotational speed than roll 25 can enhance development and common rotation of roll 25 at tangential developing area 32 with respect to the rotation of drum 30 helps contain any toner clouding between rolls 24 and 25. The flow diverter assembly 28 aids in uniform flow and allows for flow proportioning to the rolls 24 and 25.

As is known in the art, magnetic brush rolls 24 and 25 are each formed with a magnetically transparent rotatable cylinder 35 and 36 each powered to rotate in the directions indicated by the arrows. As best seen in FIG. 2, brush assembly 24 includes a magnet assembly configuration 38 which includes a core 39 of iron or other high magnetic permeability material. Arrayed around core 39 are a plurality of spaced bar magnets 41–48 with the polarities shown, the entire magnet assembly 38 remaining stationary as the cylindrical roll 35 rotates around it. Magnet 41 is of adequate strength to extract toner laden carrier 11 to roll cylinder 35 at a rate more than sufficient to meet the necessary flow criteria of the developer. Magnets 42–44 are arrayed with alternating polarities as shown, to hold the carrier on the surface of roll 35 in the primary transport zone. Mix passes between roll 24 and 25 and doctoring blade 49 is placed such that the flow is regulated thereby. At about the line of centers between rolls 24 and 25, non-magnetic flow diverter-splitter assembly 28 proportions the mix to each of rolls 24 and 25. Thus, both rolls become developing rolls.

Magnet 45 is positioned to continue retention of the mix on the surface of cylinder 35 to intimate contact thereof in the initial developer area 31. This mix is scavenged by magnet 46 after passage from the developing area 31. In view of the distance this mix must travel from the scavenging zone associated with magnet 46, magnet assembly 38 includes an additional magnet 48 to enhance flow return to reservoir 17 through the reservoir return zone associated with cylinder 35. The mix from either roll 24 or 25 returned to sump area 12 is immediately intermingled with the contents of channels 16 and 17 as replenished from source 15 for recycling via the auger 14 and 18 configuration.

Brush roll 25 is arranged to provide a brush formation sufficiently soft in the developer area 32 so as to avoid abrasion of the photoconductor on the surface of drum 30 while allowing closely packed mix to yield smoothly textured copy. More particularly, brush roll 25 is likewise formed with a magnetically transparent cylindrical outer element 50 which rotatably moves around a fixed magnet assembly 51. Magnets 53–57 which typically may be of Indox-5 or equivalent high energy material, are mounted on an iron or other high permeability core 52 and extend the length of core 52. The north/south polarity orientations of the magnetic lines generally extend radially relative to cylindrical roll 50 and the magnets are as far from the roll center as practical to take advantage of the strong fields near the pole faces. Magnet spacing around the roll 50 is such that the reluctance in the air gap between magnets 53–57 is reduced, yet enough field is available outside the roll to give uniform and strong magnetic forces on carrier beads which conform to the available fields outside the roll.

Magnet 53 is arranged for initial acquisition of toner carrying material diverted by assembly 28 and to define the initial portion of the toner material carrying zone associated with cylinder 50. At the developing zone 32 where beads are physically constricted by the photoconductor surface of drum 30 and the magnetic brush roll surface 50, the magnetic forces are weaker to give a soft brush formation against the photoconductor surface of drum 30. This is effected by arranging the polarities of magnets 54 and 55 in common directions as shown, thereby rendering the softer flux field in zone 32.

Magnets 53–57 are effectively arrayed so as to define a transport zone around a portion of the perimeter cylinder 50. Magnet 53 is located in close proximity to the divergence point associated with assembly 28 from roller 24 to attract carrier beads to the magnet brush roll surface of cylinder 50. Magnets 54 and 55 aid in holding the carrier beads to the surface of roll 50 as they are transported through developing zone 32 and between the roll 50. After the carrier has passed developing zone 32, it is again desirable to have control over it by stronger magnetic fields which are provided by magnets 56 and 57. This directs the toner carrying mix away from the photoconductor surface of drum 30 and transports it to a point where it can be released for return to the mix reservoir, thus avoiding any unintended carrying of the toner mix out of the developer on drum 30. Therefore, magnets 56 and 57 effect a scavenging function somewhat similar to magnets 46 and 48 for drum 24.

A typical optimum spacing of about 38 degrees between magnet axes is desirable when use of five magnets configured as shown is employed with conventionally available magnets. The field strength at the pole faces for the magnets is approximately 1200 to 1300 gauss.

Diverter-splitter assembly 28 is formed from an elongated plate 58 having an initial divider edge for engaging the toner and dividing the proportion between rolls 24 and 25. Preferably, the initial or leading edge of plate 58 is of a relatively blunt character, rather than a sharp knife edge type to reduce potential wear or damage to the toner carrier beads. This divider plate 58 is pivotably attached to mounting bar 59 shown sectioned at the hinge point in FIG. 2. Bar 59 is in turn rigidly attached to the side walls of the structure or to a mounting bracket or the like such as by screw holes 60 and 61 visible in FIG. 1. Extending from one end near the outer edge of divider plate 58 is a rod 62 (note FIG. 1) adapted for adjusting the divider position of plate 58 thereby allowing selectable control of the toner exchange between drums 24 and 25. The positional control of adjusting rod 62 will be somewhat better understood in conjunction with the subsequent description of the FIG. 5 embodiment for the divider-splitter structure.

Figure 3:
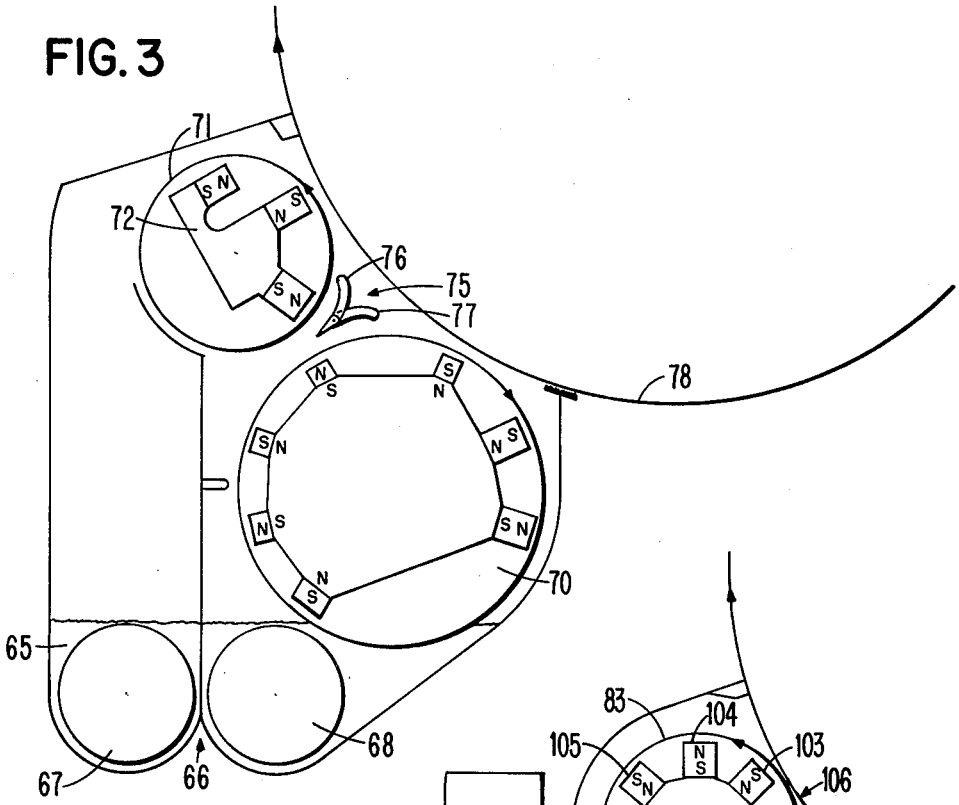
FIG. 3 is a side partially sectioned view of another arrangement for implementing the present invention.

FIG. 3 illustrates a modified embodiment of the present invention which is somewhat similar in overall operation to the FIG. 1 and 2 embodiment in that a toner carrying mix 65 is contained within a sump 66 having dual augers 67 and 68 for continual mixing thereof. Replenisher apparatus is not specifically shown in FIG. 3, but could be included if desired. The magnetic brush drum roller 70 is substantially the same as its counterpart 24 in FIGS. 1 and 2 and the magnetic brush roller 71 is likewise generally similar to its counterpart in roller 25 of FIGS. 1 and 2, with the exception of a somewhat different magnet configuration 72. Further, the diverter-splitter assembly 75 is operationally the same as regards initial division of mix transported by conveyor roll 70 to the division point. However, the non-magnetic bead controller of assembly 75 includes independently adjustable rear elements 76 and 77 for smoothing the mix relative to each of drums 70 and 71, so that it is more uniformly distributed over the surface of these drums prior to engaging the developing zones associated with the photoconductor drum 78.

Figure 4:
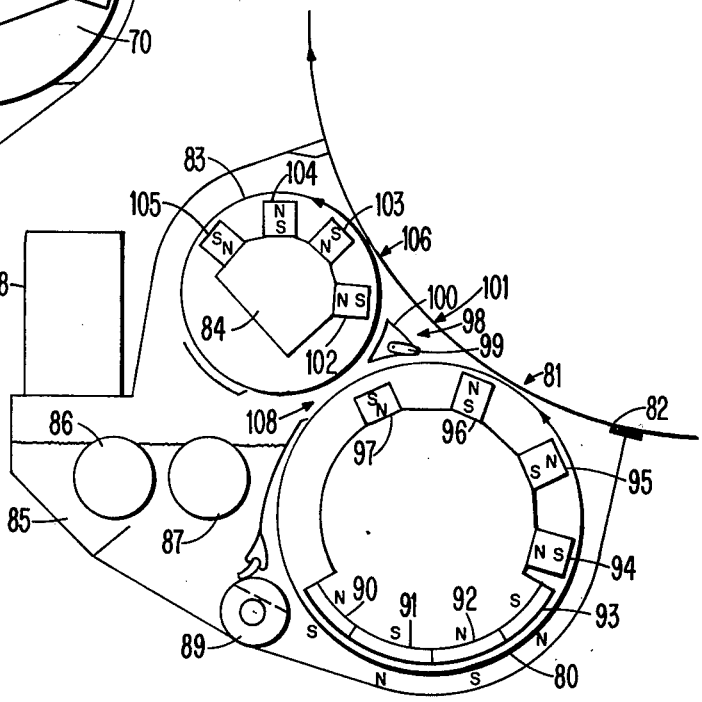
FIG. 4 is a side section view of an implementation of another arrangement of the present invention utilizing brush rolls which rotate in common directions.

FIG. 4 shows an alternative embodiment wherein, instead of transferring the mix flow from the lower to the upper roll, part of the flow is diverted back to the mixing reservoir from the initial conveyor roller assembly 80 after passage through the initial developing area 81 on the surface of photoconductor drum 82. The embodiment of FIG. 4 transfers mix to the upper roll assembly 83 which will be noted as being configured somewhat similarly to roll 25 of FIGS. 1 and 2, but with one less magnet element associated with the bar magnet assembly 84, since mix transfer is not effected at the tangential point between the two rolls. Mix transferred to upper roller 83 is controlled so as to produce excellent development of fine contrasting images while containing background to an acceptable level.

In FIG. 4, the reservoir and mixing region 85 is substantially the same as described heretofore, using dual internal and oppositely directed augers 86 and 87 with a replenisher 88 introducing additional toner mix to the contents of reservoir 85 as required. As mix passes through gate 89 it comes under the control of roll 80 by the magnetic attraction and array of magnets indicated generally as 90–93. Magnets 90–93 may be segmented or extruded into the configuration shown. As the mix begins moving upward on the surface of the outer cylinder surface for roller 80, it comes under the stronger influence of magnets 94, 95 and 96. The magnetic fields from between magnets 95 and 96 provide the relatively soft developer application in zone 81 somewhat similarly to that described hereinbefore, relative to magnets 54 and 55 in FIG. 2. That is, note that magnets 95 and 96 have common magnetic radial orientation to produce this soft "footprint" result. This effects the initial development stage in area 81.

The mix as it passes out of the initial developing zone 81 associated with brush roller 80 is split by a vane or flow diverter-splitter assembly 98. Assembly 98 includes the initial divider vane or plate 99 which is adjustable relative to the spacing to the surface of the outer cylinder of roll 80 and which further is pivotably attached to a fixed mounting beam 100. At diverter-splitter assembly 98, a more precise amount of mix is diverted to brush roller 83 and includes most of the mix which has developed the image initially in the area 81. This portion of the mix will have higher charged toner (since it has given up some toner) which is desirable for good low background development at roll 83. The mix moves from roll 80 to roll 83 through a transition zone 101 by centrifugal force after it passes magnet 96 and magnetic fields from magnet 96 become too weak to contain it on roll 80. A relatively weak magnet 97 controls the portion of the mix on roll 80 that is not to be transferred to roll 83, but is to be returned to reservoir 85. The portion of the mix travelling through region 101 becomes attracted to roll 83 by the strong magnetic fields of magnet 102. Note that magnets 102 and 103 are of like polarity facing the drum 82 to give a soft developing footprint. Magnets 103, 104 and 105 link strongly together to scavenge the mix and control it on roll 83 until ready to be released to reservoir 85. Mix from roll 80 returns to reservoir 85 through region 108 between the peripheral edges of drum 80 and 83. At reservoir 85, toner is added to the mix from replenisher 88 and mix by augers 86 and 87.

The magnet configurations shown are segmented magnets mounted on a ferrous core; however, extruded magnet cores giving the same magnetic field pattern may be used if desired. Bias voltages are maintained on the brush rollers in the manner substantially as has been known in the prior art. Each such roll can have its bias level independently set to control background and set for low contrast levels. Bias voltages, roll speeds, engagements to the photoconductor and diverting mix by the use of the splitter bar assemblies from the initial to the secondary roll, are all adjustments available to optimize operating conditions. Longer carrier life may be realized since lower roll speeds may be tolerated.

Figure 5:
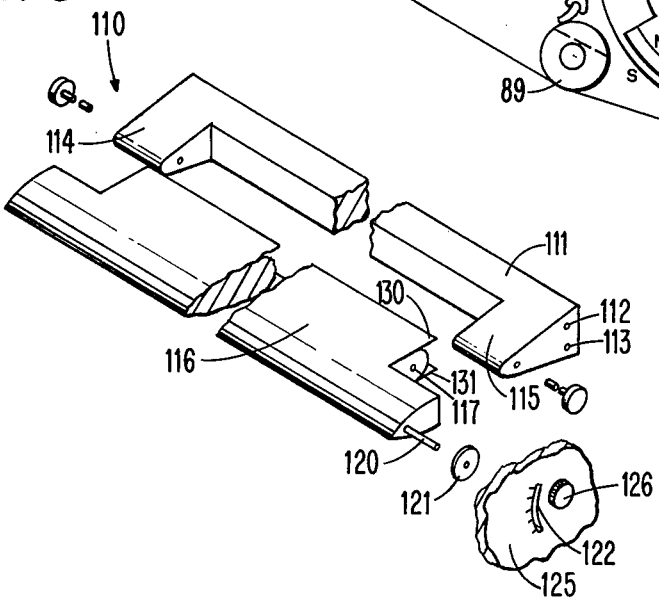
FIG. 5 is a exploded view of the adjustment controls for the present invention and further illustrating an additional potential modification thereof.

FIG. 5 illustrates a diverter-splitter assembly 110 substantially similar to that described hereinbefore. That is, a relatively rigid mounting beam 11 has threaded holes such as 112 and 113 on each end for fixed mounting between walls or mounting plates of the machine and forwardly extending ears 114 and 115 having pivot holes therethrough. Thus, the divider plate 116 formed as shown, fits within the forward slot of beam 111 so that holes such as 117 will align with the mounting ears 114 and 115 for pivotal retention therein. A bar or rod 120 extends from proximity to the forward or diverting edge of member 116 and fits through a sealing washer 121 and thence through an open slot 122 through the side wall 125 of the machine with a gripper cap or nut 126 fitting on the end of rod 120. Typically, nut 126 will be of such a type as to allow secure positioning of rod 120 once a desired position has been selected. Means such as packing washer 121, a sliding plate or the like are preferably included of sufficient size and material to ensure isolation of slot 122 from the exterior of side wall 125.

Note that the diverter plate 116 includes two generally flexible flaps 130 and 131 extending from the rear edge thereof so as to overlap the surface of mounting bar or beam 111 and thus isolate the joint between elements 111 and 116 from toner material migration.

As mentioned, bias voltages, roll speeds, engagements relative to the photoconductor surface and magnet orientations are adjustments available for optimizing operation. The initial or lower conveyor/developer roll provides greater developing of the toner on the electrostatic image and serves to refine the developing image. In typical applications, the initial or conveyor roller such as 24 or 80 operates at between 100 to 250 rpm's or 13 to 33 inches per second surface speed while the secondary roller such as 25 or 83 operates at 300 to 600 rpm's and 62 and 125 inches per second surface speeds. The typical gap between the initial or conveyor roller 24 or 80 and the associated photoconductor drum is 0.050 to 0.100 inches while the gap in the developing area for the secondary roller is 0.045 to 0.060 inches. Typical bias voltages for the initial conveyor roller are 150 to 400 volts while the secondary roller is 200 to 600 volts. The drum photoconductor surface speed is typically 20 to 40 inches per second.

Although the present invention has been described with particularity relative to the foregoing detailed description of the exemplary preferred embodiments, various modifications, changes, additions and applications will be readily apparent to those having a normal skill in the art without departing from the spirit of this invention.

What is claimed is:

1. Apparatus for applying magnetically attractable toner carrying materials from a supply source to an area of a member containing a latent image requiring development comprising:

a first magnetic brush having a movable element cooperative with a first magnet configuration for magnetically extracting and retaining toner carrying material from the supply source onto a surface of said element and for transporting said extracted material into intimate contact with a first portion of the latent image area;

a second magnetic brush mounted adjacent said first brush and having a movable element cooperative with a second magnet configuration for magnetically retaining toner carrying material on a surface of said element and for delivering said retained materials into intimate contact with a second portion of the latent image area;

means positioned between said first and second brushes for diverting a portion of the toner carrying materials from said first brush element surface to said second brush element surface for transport thereby to the second latent image area portion; and means selectably adjusting said diverting means for controlling the quantity of tone carrying materials transferred from said first brush to said second brush.

2. Apparatus in accordance with claim 1 wherein said first and second brush movable elements respectively include first and second thin, magnetically transparent sheets formed as a movable closed loop in surrounding relation to the associated said magnet configuration;

said first magnet configuration producing a magnetic field through said first sheet for magnetically attracting and retaining the toner carrying material against said first sheet throughout movement thereof between the supply source and at least a point beyond said diverting means.

3. Apparatus in accordance with claim 2 wherein said second magnet configuration produces a magnetic field through said second sheet for magnetically retaining the toner carrying material against said second sheet throughout the movement thereof between a point in proximity to said diverting means and a point beyond the area of said intimate contact with the latent image area.

4. In an apparatus for developing latent electrostatic images present on the circumferential photoconductor surface of a rotating drum by using magnetically attractable toner carrying materials introduced into a sump, an improvement comprising:

first and second magnetic brush assemblies each including a magnetically transparent cylinder rotatably mounted in surrounding relation to an elongated magnet configuration;

said first magnetic brush assembly being mounted for causing the external surface of said first cylinder to pass through the sump and in spaced proximity to the photoconductor surface, said first brush assembly magnet configuration producing a magnetic field through said first cylinder through a zone coextensive with movement of said first cylinder from the sump to at least the point of proximity to the photoconductor surface for transporting the toner carrying materials into intimate contact with the photoconductor surface at least at said point of photoconductor proximity;

said second magnetic brush assembly being mounted in parallel spaced relation to both said first brush assembly and the drum photoconductor surface, said second brush assembly magnet configuration producing a magnetic field through said second cylinder through a zone coextensive with movement of said second cylinder from a point in proximity to said first brush assembly to a point beyond the photoconductor surface with said second brush assembly zone including an intermediate point in spaced proximity to the photoconductor surface for transporting the toner carrying materials into intimate contact with the photoconductor surface at least at said intermediate point;

an elongated plate positioned in parallel relation between said brush assemblies for diverting at least a portion of the toner materials from said first brush assembly cylinder onto the initial portion of said zone on said second brush assembly cylinder; and means adjustably positioning said elongated plate for controlling the quantity of toner carrying materials diverted from said first cylinder to said second cylinder.

5. An improved apparatus in accordance with claim 4 wherein said elongated plate includes a leading edge oriented in a generally tangential relation to said first cylinder for intercepting toner carrying materials thereon and a surface extending from said leading edge for directing transfer of toner materials intercepted by said leading edge onto the initial portion of said second cylinder zone.

6. An improved apparatus in accordance with claim 5 which includes at least one elongated element receiving toner carrying materials from said elongated plate surface for directing the toner carrying materials towards the surface of one of said cylinders, and means for adjustably moving said elongated element for controlling the spacing thereof from the surface of the associated said cylinder.

7. An improved apparatus in accordance with claim 5 wherein said first and second cylinders rotate in opposite directions with the closest point of proximity therebetween being included intermediate in said first brush assembly zone, said elongated plate having said leading edge thereof positioned in proximity to the narrowest line of separation between said cylinders, said elongated plate surface extending in a direction generally towards the latent image drum.

8. An improved apparatus in accordance with claim 7 which includes means adjustably positioning said plate leading edge relative to said first cylinder surface for controlling the quantity of toner carrying materials transferred from said first cylinder to said second cylinder.

9. An improved apparatus in accordance with claim 5 wherein said first and second cylinders rotate in common directions, said elongated plate having said leading edge positioned at a line for intercepting toner carrying materials from said first cylinder after said first cylinder has passed in closest proximity to the latent image drum surface, said elongated plate surface extending into proximity to the initial portion of said second cylinder zone.

10. An improved apparatus in accordance with claim 9 which includes means adjustably positioning said plate leading edge relative to said first cylinder for controlling the amount of toner carrying materials transferred from said first cylinder to said second cylinder.

* * * * *